US009017425B2

(12) United States Patent
Jarvis

(10) Patent No.: US 9,017,425 B2
(45) Date of Patent: Apr. 28, 2015

(54) TEXTILE COLOURATION

(75) Inventor: Anthony Jarvis, Cheshire (GB)

(73) Assignee: Datalase Ltd., Cheshire (GB)

( * ) Notice: Subject to any disclaimer, the term of this patent is extended or adjusted under 35 U.S.C. 154(b) by 228 days.

(21) Appl. No.: 13/062,629

(22) PCT Filed: Aug. 26, 2009

(86) PCT No.: PCT/GB2009/051060

§ 371 (c)(1),
(2), (4) Date: Mar. 7, 2011

(87) PCT Pub. No.: WO2010/029328

PCT Pub. Date: Mar. 18, 2010

(65) Prior Publication Data

US 2011/0167572 A1 Jul. 14, 2011

(30) Foreign Application Priority Data

Sep. 10, 2008 (GB) ..... 0816539.1
Apr. 2, 2009 (GB) ..... 0905785.2

(51) Int. Cl.

| | |
|---|---|
| ***D06P 5/20*** | (2006.01) |
| ***D06P 1/00*** | (2006.01) |
| ***D01F 1/04*** | (2006.01) |
| ***D01F 1/06*** | (2006.01) |
| ***D06P 1/653*** | (2006.01) |
| ***G03C 1/73*** | (2006.01) |
| ***G03C 1/76*** | (2006.01) |

(52) U.S. Cl.
CPC . *D06P 1/004* (2013.01); *D01F 1/04* (2013.01); *D01F 1/06* (2013.01); *D06P 1/6533* (2013.01); *D06P 5/2005* (2013.01); *D06P 5/2077* (2013.01); *D06P 5/2083* (2013.01); *G03C 1/73* (2013.01); *G03C 1/7642* (2013.01)

(58) Field of Classification Search
USPC ..... 8/444
See application file for complete search history.

(56) References Cited

U.S. PATENT DOCUMENTS

| | | | | |
|---|---|---|---|---|
| 3,501,303 | A | 3/1970 | Foltz et al. | |
| 3,772,028 | A | 11/1973 | Fico et al. | |
| 4,208,186 | A | 6/1980 | Patel | |
| 4,215,208 | A | 7/1980 | Yee et al. | |
| 4,228,126 | A | 10/1980 | Patel et al. | |
| 4,705,742 | A | 11/1987 | Lewis | |
| 4,788,151 | A * | 11/1988 | Preziosi et al. | 436/2 |
| 5,004,671 | A | 4/1991 | Nishimura et al. | |
| 5,049,428 | A | 9/1991 | Kanno et al. | |
| 5,137,964 | A | 8/1992 | Lewis et al. | |
| 5,149,617 | A | 9/1992 | Liu | |
| 5,731,112 | A | 3/1998 | Lewis et al. | |
| 2004/0026007 | A1 * | 2/2004 | Hubert et al. | 156/64 |
| 2007/0273951 | A1 * | 11/2007 | Ribi | 359/237 |
| 2008/0305328 | A1 | 12/2008 | Green et al. | |
| 2008/0318154 | A1 * | 12/2008 | Wyres | 430/270.1 |
| 2009/0191480 | A1 | 7/2009 | Rogers et al. | |
| 2011/0017961 | A1 | 1/2011 | Jarvis | |
| 2011/0109014 | A1 | 5/2011 | Rogers et al. | |
| 2011/0122347 | A1 | 5/2011 | Jarvis et al. | |
| 2011/0136934 | A1 | 6/2011 | Jarvis et al. | |
| 2011/0148092 | A1 | 6/2011 | Jarvis et al. | |
| 2011/0151380 | A1 | 6/2011 | Jarvis et al. | |
| 2011/0151384 | A1 | 6/2011 | Walker et al. | |
| 2011/0155815 | A1 | 6/2011 | Jarvis et al. | |
| 2011/0159268 | A1 | 6/2011 | Jarvis | |
| 2011/0167572 | A1 | 7/2011 | Jarvis | |
| 2012/0021362 | A1 | 1/2012 | Jarvis et al. | |
| 2012/0021363 | A1 | 1/2012 | Jarvis | |

FOREIGN PATENT DOCUMENTS

| | | |
|---|---|---|
| EP | 2 082 890 | 7/2009 |
| JP | 02-202923 | 8/1990 |
| WO | WO 92/07297 | 4/1992 |
| WO | WO 2005/036109 | 4/2005 |
| WO | WO 2006/018640 A1 | 2/2006 |
| WO | WO 2007/045912 A1 | 4/2007 |
| WO | WO 2008/050153 A1 | 5/2008 |
| WO | WO 2008/063680 | 5/2008 |
| WO | WO 2010/026408 A2 | 3/2010 |

OTHER PUBLICATIONS

Database WPI Week 200838, Accession No. 2008-F99135, XP-002589253, corresponding to Korean Publication No. KR100779986, published Nov. 28, 2007.

* cited by examiner

*Primary Examiner* — Harold Pyon
*Assistant Examiner* — Katie L Hammer
(74) *Attorney, Agent, or Firm* — Saliwanchik, Lloyd & Eisenschenk

(57) ABSTRACT

A textile comprising a diacetylene compound which is capable of changing color when irradiated with light energy. Methods of imparting color to textiles comprising irradiating the textile with light energy are also provided.

14 Claims, No Drawings

TEXTILE COLOURATION

CROSS REFERENCE TO A RELATED APPLICATION

This application is a National Stage Application of International Application Number PCT/GB2009/051060, filed Aug. 26, 2009; which claims priority to Great Britain Application No. 0816539.1, filed Sep. 10, 2008; and Great Britain Application No. 0905785.2, filed Apr. 2, 2009; all of which are incorporated herein by reference in their entirety.

FIELD OF THE INVENTION

The present invention relates to coloured textiles, and methods for producing them.

BACKGROUND OF THE INVENTION

Methods of textile colouration are well known in the art and have been practiced for centuries. However, textile colourants typically have to be admixed to obtain a particular shade of colour and this requires many stock keeping units. Admixing also requires time, which is inconvenient in today's fashion markets which demand last minute processing.

Textiles are often printed using contact printing apparatus and ink. Contact printing is complex, lacks resolution and is time consuming. It may also result in damage to the textile being printed.

SUMMARY OF THE INVENTION

The first aspect of the invention is a textile comprising a diacetylene compound which is capable of changing colour when irradiated with light energy.

The second aspect of the invention is a method of imparting colour to a textile, comprising treating the textile with a diacetylene compound, and irradiating the textile with light energy to change the colour of the diacetylene compound.

This invention advantageously allows bulk colouration of textiles in a fast and simple manner. The invention also allows images to be generated on textiles. This means that patterns of high resolution can be formed in a manner which does not damage the textile being printed.

DESCRIPTION OF THE INVENTION

Particularly preferred diacetylenes are those that impart essentially no colour to the textile prior to the light activated colour change reaction. It is preferred that the textile is essentially colourless prior to irradiation. By this is meant that the textile contains no colourant, such as dye or pigment, which imparts colour (it may of course comprise the diacetylene compound in its inactive form).

In one embodiment of the invention, the diacetylene compound is capable of further activation, after the first irradiation, to yield another colour change reaction to produce a colour different to the first one obtained. The activation may involve irradiation with laser or non-coherent radiation. The step of further irradiation may involve simple heating with a suitable heat source.

Preferably, a mixture of diacetylenes is used, each of which can form a different colour or shade of colour.

Any diacetylene or combination of diacetylene and other substances capable of undergoing a colour change reaction upon exposure to light may be used in the present invention.

Diacetylene compounds are substances which include at least one diacetylene group, i.e. —C≡C—C≡C—. Particularly preferred are diacetylene compounds that exhibit a polychromic colour change reaction. These compounds are initially colourless but on exposure to suitable light, such as a ultra-violet light, undergo a colour change reaction to produce a blue colour. Certain diacetylenes in their blue form can then be exposed to further light such as near-infrared light, which converts the blue form into a magenta, red, yellow and green form.

Specific examples of diacetylene compounds may be used in the present invention are given in the published patent application numbers WO2006/018640 and WO2009/081385.

Further examples include those represented by the following general structures:

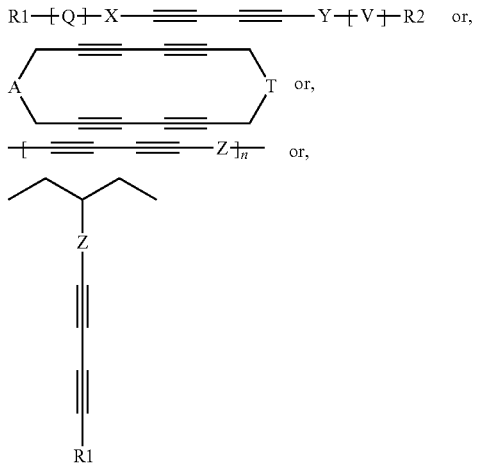

wherein,

X and Y are divalent straight-chain or branched alkylene type groups $(—CH_2—)_n$ wherein n=0 to 24, or a divalent phenylene type group $(—C_6H_4—)_n$ wherein n=0 to 1 or a combination of both types;

Q and V, if present, are divalent bridging groups such as —S—, —O—, —NHR'— wherein R' is hydrogen or alkyl, amide, ester or thioester groups, carbonyl or carbamate;

R1 and R2 are H or alkyl;

A and T are divalent groups that can either be an alkylene or phenylene type such as X or Y, or a bridging type such as Q or V, or a combination of both types, X or Y that additionally comprises a Q or V group;

Z is a divalent group such as X or Q or a combination of both, X that additionally comprises a Q group, or Z can be not present, and n is 2 to 20,000,000.

Groups X and Y are optionally substituted, preferably at the α, β or γ position with respect to the diacetylene group. For instance, there may be an α-hydroxy group, as shown in the formula below:

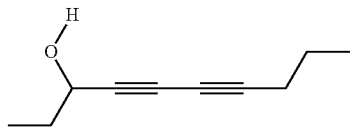

The diacetylene may be symmetrical or non-symmetrical.

Q and V are optionally substituted with groups such as amine, alcohol, thiol or carboxylic acid. Both Q and V may be present, or alternatively, just Q.

Where R1 and R2 in the above compounds are alkyl, they may be straight or branched chain and may additionally comprise other functional groups known in organic chemistry such as alcohol, amine, carboxylic acid, aromatic ring systems and unsaturated groups such as alkenes and alkynes.

Groups R1, R2, Q, V, X and Y may comprise ionic groups, which can be anionic or cationic. Examples include sulphate groups (—$SO_3$—) and ammonium groups. The ionic groups can have any suitable counterion.

Further diacetylene compound examples are diacetylene carboxylic acids and derivatives thereof. A particularly preferred diacetylene carboxylic acid compounds are 10,12-pentacosadiynoic acid and 10,12-docosadiyndioic acid and their derivatives thereof. Further examples include: 5,7,-dodecadiyndioic acid, 4,6-dodecadiynoic acid, 5,7-eicosadiynoic acid, 6,8-heneicosadiynoic acid, 8,10-heneicosadiynoic acid, 10,12-heneicosadiynoic acid, 10,12-heptacosadiynoic acid, 12,14-heptacosadiynoic acid, 2,4-heptadecadiynoic acid, 4,6-heptadecadiynoic acid, 5,7-hexadecadiynoic acid, 6,8-nonadecadiynoic acid, 5,7-octadecadiynoic acid, 10,12-octadecadiynoic acid, 12,14-pentacosadiynoic acid, 2,4-pentadecadiynoic acid, 5,7-tetradecadiynoic acid, 10,12-tricosadiynoic acid 2,4-tricosadiynoic acid, and derivatives thereof. Diacetylene alcohols and diol compounds and derivatives thereof are also preferred, examples include: 5,7-dodecadiyn-1,12-diol, 5,7-eicosadiyn-1-ol, 2,4-heptadecadiyn-1-ol, 2,4-hexadiyn-1,6-diol, 3,5-octadiyn-1,8-diol, 4,6-decadiyn-1,10-diol, 2,7-dimethyl-3,5-octadiyn-2,7-diol, 14-hydroxy-10,12-tetradecadiynoic acid. Others include 1,6-diphenoxy-2,4-hexadiyne, 1,4-diphenylbutadiyne, 1,3-heptadiyne, 1,3-hexadiyne and 2,4-hexadiyne.

A combination of different diacetylenes can also be employed. A particularly preferred combination is that of 10,12-pentacosadiynoic acid or 10,12-docosadiyndioiac acid and derivatives thereof and 2,4-hexadiyn-1,6-diol. 10,12-pentacosadiynoic acid can produce blue, red and yellow. 2,4-hexadiyn-1,6-diol can produce a cyan colour. Activating 10,12-pentacosadiynoic acid to yellow and 2,4-hexadiyn-1,6-diol to cyan simultaneously gives rise to green.

A diacetylene compound that is 'activatable', i.e. has a first solid form that is relatively unreactive to light, but upon 'activation' is transformed into a second form that is relatively reactive to light and is thus capable of undergoing a colour change reaction to create a visible image, has particular utility in the present invention. Without being limited by theory the activation could be a re-crystallisation, crystal form modification, co-crystal combination or a melting/re-solidification process.

Reversibly activatable diacetylenes that can flip between unactivated and activated forms in response to or removal of a stimulus also form part of the present invention.

Particularly preferred diacetylenes are those that after initial melting and re-solidification activation are colourless but become blue on exposure to light, particularly UV light. The most preferred diacetylenes compounds are carboxylic acids and derivatives thereof where:

R—C≡C—C≡C—R' either R and/or R' comprises a COX group,
where X is: —NHY, —OY, —SY, where Y is H or any group comprising at least one carbon atom.

Particularly preferred still are derivatives in which the carboxylic acid group has been functionalised into an amide, ester or thioester. These can be easily made by reacting a diacetylene carboxylic acid with a chlorinating agent such as oxalyl chloride and then reacting the diacetylene acid chloride with a nucleophilic compound such as an amine, alcohol or thiol. A particularly preferred diacetylene carboxylic acid compound is 10,12-docosadiyndioic acid and derivatives thereof such as amides, esters, thioesters and the like. Especially particularly preferred 10,12-docosadiyndioic acid derivatives are amides. A particularly preferred still 10,12-docosadiyndioic acid amide derivative is the propargylamide in which at least one, preferably both carboxylic acid groups have been transformed into the propargylamide, as shown below:

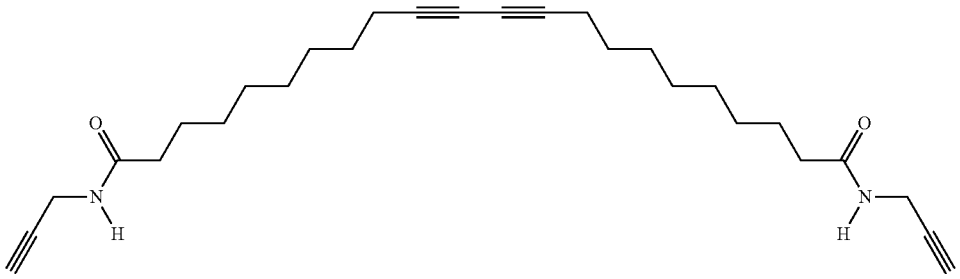

Propargylamides are made by reacting carboxylic acids with propargylamine. Other preferred amines that can be used to create suitable amides include: dipropargylamine and 1,1-dimethylpropargylamine.

The activatable diacetylene is generally used together with a NIR light absorbing agent, which is a compound that absorbs light in the wavelength range 700 to 2500 nm.

A NIR light source, such as a NIR fibre laser, is used to heat the textile comprising the activatable diacetylene only in the areas where the image is required. A UV light source, such as a germicidal lamp, is then used to flood the textile with UV light. However, the diacetylene compound only undergoes a colour change reaction to create an image in the areas which were initially exposed to NIR light. The areas of the textile unexposed to NIR light undergo a negligible colour change reaction, remain essentially colourless, and are stable to background radiation. A thermal print head may be used to initiate the heat-based pre-activation step.

Specific examples of NIR light absorbing agents include:

i. Organic NIR absorbing agents
ii. NIR absorbing 'conductive' polymers
iii. Inorganic NIR absorbing agents
iv. Non-stoichiometric inorganic absorbing agents.

Particularly preferred NIR absorbing agents are those that have essentially no absorbance in the visible region of the spectrum (400 to 700 nm) and thus give rise to coatings that appear visibly colourless.

Organic NIR absorbing agents are known as NIR dyes/pigments. Examples include but are not limited to: families of metallo-porphyrins, metallo-thiolenes and polythiolenes, metallo-phthalocyanines, aza-variants of these, annellated variants of these, pyrylium salts, squaryliums, croconiums, amminiums, diimoniums, cyanines and indolenine cyanines.

Examples of organic compounds that can be used in the present invention are taught in U.S. Pat. No. 6,911,262, and are given in Developments in the Chemistry and Technology of Organic dyes, J Griffiths (ed), Oxford: Blackwell Scientific, 1984, and Infrared Absorbing Dyes, M Matsuoka (ed), New York: Plenum Press, 1990. Further examples of the NIR dyes or pigments of the present invention can be found in the Epolight™ series supplied by Epolin, Newark, N.J., USA; the ADS series supplied by American Dye Source Inc, Quebec, Canada; the SDA and SDB series supplied by HW Sands, Jupiter, Fla., USA; the Lumogen™ series supplied by BASF, Germany, particularly Lumogen™ IR765 and IR788; and the Pro-Jet™ series of dyes supplied by FujiFilm Imaging Colorants, Blackley, Manchester, UK, particularly Pro-Jet™ 830NP, 900NP, 825LDI and 830LDI. Further examples are taught in WO08/050,153.

Examples of NIR absorbing 'conductive' polymers include PEDOT such as, the product Baytron® P supplied by HC Starck. Further examples are taught in WO05/12442.

Examples of inorganic NIR absorbing agents include copper (II) salts. Copper (II) hydroxyl phosphate (CHP) is particularly preferred. Further examples are taught in WO05/068207.

Examples of non-stoichiometric inorganic absorbing agents include reduced indium tin oxide, reduced antimony tin oxide, reduced titanium nitrate and reduced zinc oxide. Further examples are taught in WO05/095516. Reduced indium tin oxide is particularly preferred in combination with the use of a 1550 nm to 2500 nm laser.

It is particularly preferred if the absorption profile of the NIR absorbing agent approximately matches the emission wavelength(s) of the NIR light source employed.

Other light absorbing agents that can be used, instead of the NIR absorbing agent include UV (120 to 400 nm), visible (400 to 700 nm) and mid-infrared (~10.6 microns) light absorbing agents. Examples includes dyes/pigments, UV absorbers and Iriodin type agents.

Charge transfer agents may be used together with a diacetylene in the present invention. These are substances that are initially colourless but react with protons ($H^+$) to produce a coloured form. Charge transfer agents that form part of the present invention include compounds known as carbazoles and suitable examples are described in WO2006/051309. Further charge transfer agents known to those skilled in the art such as leuco dyes can also be used. Charge transfer agents are usually used in combination with other substances such as light absorbing agents which can be wavelength specific, heat generating agents, acid generating agents and the like.

A particularly preferred combination for use in this invention is a diacetylene such as 10,12-pentacosaidiynoic acid, or 10,12-docosadiyndioic acid (or a derivative thereof), to give blue and red, with a charge transfer agent that generates green.

A laser, or non-coherent radiation (in combination with a mask) may be used for printing images on a textile comprising a diacetylene. The radiation source is normally computer controlled to ensure accurate image generation. Suitable lasers include UV, visible, NIR and $CO_2$ lasers. The laser can be pulsed or continuous wave. The radiation can have a wavelength in the region 120 nm to 20 microns.

The skilled person can select a suitable diacetylene, or combination of diacetylenes, according to the eventual colours required. The marking laser intensity, wavelength and/or time of exposure can all be varied to ensure that an appropriate colour is produced. WO2006/114594 describes an apparatus which includes a laser diode and galvanometer, and is suitable for aligning the laser beam onto the colour forming composition in the present invention. WO2007/039715 furthermore describes a method of inkless printing. As in these publications, the colour of the diacetylene in this invention is selectable according to the fluence level of the irradiation at a desired point.

Textiles are typically formed of fibres. The diacetylene can be dissolved or dispersed with the textile fibres or adsorbed onto their surface. The diacetylene can be mechanically entrapped with the textiles fibres, physically attached, or covalently bonded to the polymer chains that make up the textile fibres.

The diacetylene may be water or solvent soluble and may be applied to textile fibres in the form of a dye. The diacetylene may alternatively be water or solvent dispersible and be applied in the form of a pigment, using techniques well known in the art.

The diacetylene may be applied to the textile fibres, for instance, using any conventional colouration process including long liquor exhaustion baths, padding, thermal transfer, melt spin extrusion, dry spinning and wet spinning or added directly to the polymerisation reaction.

The diacetylene may be applied to the textiles in the form of a laser-imageable composition such as a fluid ink or coating formulation, which comprises the diacetylene compound and a binder, and any other necessary components.

Further additives may include NIR absorbers, dispersing agents, acid/base generators, particularly photo acid/base generators, UV absorbers/stabilizers, processing aids, cosolvents, whitening agents and foam suppressants. Suitable examples of near-infrared absorbers include: copper (II) hydroxyl phosphate, mixed metal oxides such as indium tin oxide, antimony tin oxide including non-stoichiometric reduced versions and coated micas thereof, conductive polymers and organic dye/pigment type near infrared absorbers such as N,N,N',N'-tetrakis(4-dibutylaminophenyl)-p-benzoquinone bis(iminium hexafluoroantimonate).

The binder can be any known to those skilled in the art. Suitable examples include acrylics, methacrylics, urethanes, cellulosics such as nitrocelluloses, vinyl polyers such as acetates and butyrals, styrenics, polyethers, polyesters. The binder system can be aqueous or organic solvent based. Examples of the binder systems that can be employed include the Texicryl range supplied by Scott-Bader, the Paranol range supplied by ParaChem, the Pioloform range supplied by Wacker-Chemie, the Elvacite range supplied by Lucite International Inc., the Joncryl range supplied by Johnson Polymers, and the WitcoBond range supplied by Baxenden Chemicals.

A further embodiment of the present invention is a method of imparting colour to a textile using a diacetylene compound that is activated to its coloured form prior to its application to the textile. The method typically comprises taking the diacetylene compound, which is usually initially colourless, and activating it into its coloured (for instance, blue, red, magenta, orange, yellow or green) form, and then applying the pre-coloured diacetylene compound to the textile as a dye or pigment in order to impart colour to the textile.

The textiles of the present invention are typically comprised of fibres. The fibres can be natural or synthetic materials, or any blend thereof. Suitable examples include: cellulosics such as cotton, rayon, viscose, lyocell, hemp, flax, Tencel, jute and cellulose derivatives such as acetates, proteinaceous fibres such as animal hair such as wool or cashmere, insect secretions such as silk, or skin or hide such as leather; synthetics including: polyester such as PET, nylon such as nylon 6 and nylon 6.6, acrylic such as PAN, elastaine and polyolefins such as (PE both low and high density), and PP and the like. Other examples include aramid, modacrylic, PBI, spandex, vinyon, saran and sulfar.

The textile fibres can be in any form including loose stock, slub, sliver, yarn, fabric including woven, knitted and non-wovens, needle-felts, or carpets or whole items such as garments.

Non-woven fabrics of the present invention are useful for the production of hygiene products such as pads, sanitary towels and nappies. They are also suitable for cleaning products such as wipes, mop heads and the like. For non-woven applications it is especially preferred to use a colour forming diacetylene that has low migration from the thermoplastic used in the production of the fibres used to construct the non-woven fabric. An example of such a diacetylene is 10,12-docosadiyndioic acid and derivatives thereof, particularly amide derivatives in which one or preferably both carboxylic acid groups have been converted into amides. A particularly preferred amide is that formed with propargylamine. Bis-10,12-pentacosadiynoic acid compounds are also particularly preferred, particularly bis-10,12-pentacosadiynoic acid amides formed by reacting 10,12-pentacosadiynoic acid with a diamines. Suitable diamine include but are not limited to: ethylenediamine, butylenediamine, hexamethylenediamine and 1,12-diaminododecane.

The textile may also comprise other additives including conventional colourants such as dyes and pigments, anti-microbial agents, UV absorbers, light stabilisers, fabric softeners, surfactants, finishes, silicones, waxes, starches, flame retardants, anti-photobleaching agents, cellulose rebuilding agents, bleaches, tinting dyes, perfumes and microencapsulated agents, and traditional dyes and pigments.

EXAMPLES 10,12-Pentacosadiynoic acid was supplied by GFS Chemicals.

10,12-Docosadiyndioic acid was supplied by GFS Chemicals.

10,12-Pentacosadiynoic acid-propargylamide and 10,12-docosadiyndioic acid-propargyldiamide were made by reacting the respective acid chlorides (made by reacting 10,12-pentacosadiynoic acid or 10,12-docosadiyndioic acid with oxalyl chloride) with propargylamine (ex. GFS Chemicals).

10,12-Docosadiyndioic acid-propyldiamide was made by reacting its acid chloride (prepared as above) with propylamine (ex. Aldrich).

Bis-10,12-pentacosadiyndioic acid-1,12-dodecadiamide was made by reacting 10,12-pentacosadiynoic acid with 1,12-diaminododecane.

Copper (II) hydroxyl phosphate (CHP) powder was supplied by Budenheim.

1. 10,12-Pentacosadiynoic acid (2 g) was dissolved in ethyl acetate (200 g) and pad applied to 100% wool knitted fabric at 100% wet pick up (i.e. the weight of the fabric doubled) and dried.

2. 10,12-Pentacosadiynoic acid (2 g) was dissolved in ethyl acetate (200 g) and pad applied to 100% cotton knitted fabric at 100% wet pick up and dried.

3. 10,12-Pentacosadiynoic acid (2 g) was dissolved in ethyl acetate (200 g) and pad applied to 50:50 polyester cotton knitted fabric at 100% wet pick up and dried.

4. 10,12-Pentacosadiynoic acid (1 g) was added to an aqueous bath containing 100% polyester fabric and a suitable dispersing agent. The bath was heated to 130° C. for 30 minutes after which time it was cooled to 60° C. prior to rinsing and drying.

5. 10,12-Pentacosadiynoic acid (2 g) was dissolved in ethyl acetate (200 g) and pad applied to 50:50 polyester cotton blend woven fabric at 100% wet pick up and dried.

6 and 7. 10,12-Pentacosadiynoic-propargylamide (10 g) was added separately to LDPE and PP pellets (500 g) and melt extrusion spun into fibres.

8 and 9. 10,12-docosadiyndioic acid-propargyldiamide was separately added to LDPE (8) and PP (9) pellets and melt extrusion spun into fibres.

10 and 11. Bis-10,12-pentacosadiyndioic acid-1,12-dodecadiamide was separately added to LDPE (10) and PP (11) pellets and melt extrusion spun into fibres.

The fibres prepared in examples 6 to 11 were used to construct a non-woven fabric suitable for use in the construction of a nappy, sanitary towel or other absorbent pad.

All the textile fibres prepared above were initially colourless but on exposure to broadband UV light became blue. Subsequent heating converted the blue into a red colour.

A UV laser operating with a wavelength of 266 nm, linked to an IBM compatible pc with appropriate software was used to print multi-coloured text and images onto the above textiles.

A broadband non-coherent UV lamp was used to impart colour to and in combination with a suitable mask, print text and images onto the above textiles.

Studies showed that 10,12-docosadiyndioic acid-propargyldiamide and bis-10,12-pentacosadiyndioic acid-1,12-dodecadiamide had much less migration from LDPE and PP than 10,12-pentacosadiynoic-propargylamide, making these diacetylene more suitable and therefore preferred for this application.

12. 10,12-Docosadiyndioic acid propargyldiamide and CHP were cold-patch batch applied to a variety of fabrics. The fabrics were then activated using a NIR source and then exposed to a UV source such as a germicidal lamp. Only those areas of the fabric that had been activated using the NIR source subsequently turned blue under UV light exposure.

13. 10,12-Docosadiyndioic propyldiamide in the solid powder form was turned blue by exposing it to UV light from a germicidal lamp. Some of the blue powder was also turned red by heating it in an oven to 120° C. The blue and red solid powders were then applied to a variety of fabrics, such as cotton and PP using a cold pad-batch application process. This gave coloured textiles.

The invention claimed is:

1. A method of imparting colour to a textile, comprising:

treating the textile with an activatable diacetylene compound;

activating the activatable diacetylene compound using heat that causes crystal form modification, wherein said compound does not change colour upon the activation; and irradiating the textile with light energy to change the colour of the activated diacetylene compound, wherein the activatable diacetylene compound is an amide derivative of a diacetylene.

2. The method according to claim 1, wherein the textile is treated with the diacetylene compound by applying the diacetylene to the textile using an exhaustion, pad, melt extrusion spinning, dry spinning, wet spinning or in-situ polymerisation process.

3. The method according to claim 1, wherein the diacetylene compound is anionic, cationic, zwitterionic or non-ionic.

4. The method according to claim 1, wherein the diacetylene compound comprises a carboxylic acid group or a derivative of a carboxylic acid group.

5. The method according to claim 1, wherein the light energy is supplied by a laser.

6. The method according to claim 1, comprising irradiating the textile with non-coherent radiation.

7. The method according to claim 6, further comprising using a mask, in combination with the non-coherent radiation, to print images onto the textile.

8. The method according to claim 1, wherein the textile further comprises a near-infrared absorbing agent.

9. The method according to claim 1, wherein the textile is in the form of fibres.

10. The method, according to claim 4, wherein the derivative is an amide derivative.

11. The method, according to claim 4, wherein the derivative is a propargylamide derivative.

12. The method, according to claim 8, wherein the near-infrared absorbing agent is a copper (II) hydroxide phosphate, a reduced metal or mixed metal oxide, a conductive polymer or an organic dye/pigment.

13. The method, according to claim 9, wherein the fibres are in the form of a yarn or a woven, knitted or non-woven fabric.

14. A method of imparting colour to a textile comprising:

activating an activatable diacetylene compound using heat that causes crystal form modification, wherein said compound does not change colour upon the activation;

converting the activated diacetylene compound to a coloured diacetylene compound; and adding the coloured diacetylene compound to a textile, wherein the diacetylene compound is activated by crystal form modification, and wherein the activatable diacetylene compound is an amide derivative of a diacetylene.

* * * * *